US009811952B2

(12) United States Patent
Carlson

(10) Patent No.: US 9,811,952 B2
(45) Date of Patent: Nov. 7, 2017

(54) SYSTEM AND METHOD FOR MONITORING A CONDITION OF A PAVING MACHINE

(71) Applicant: Caterpillar Paving Products Inc., Brooklyn Park, MN (US)

(72) Inventor: Nathan A. Carlson, Elk River, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 43 days.

(21) Appl. No.: 15/086,319

(22) Filed: Mar. 31, 2016

(65) Prior Publication Data

US 2017/0287236 A1 Oct. 5, 2017

(51) Int. Cl.

| | |
|---|---|
| ***E01C 5/00*** | (2006.01) |
| ***G07C 5/08*** | (2006.01) |
| ***E01C 19/22*** | (2006.01) |

(52) U.S. Cl.

CPC ..... *G07C 5/0808* (2013.01); *E01C 19/22* (2013.01); *G07C 5/0816* (2013.01); *G07C 5/0841* (2013.01); *E01C 2301/10* (2013.01)

(58) Field of Classification Search

CPC ... E01C 19/22; E01C 2301/10; G07C 5/0808; G07C 5/0816; G07C 5/0841

USPC ..... 404/84.05, 77, 79, 95, 118

See application file for complete search history.

(56) References Cited

U.S. PATENT DOCUMENTS

| | | | | |
|---|---|---|---|---|
| 6,334,735 | B1 | 1/2002 | Williams et al. | |
| 6,421,594 | B1 * | 7/2002 | Erasmus | E01C 19/48 219/528 |
| 8,297,875 | B1 * | 10/2012 | Kopacz | E01C 19/48 404/118 |
| 2005/0191127 | A1 * | 9/2005 | Pisano | E01C 19/48 404/77 |
| 2010/0329783 | A1 * | 12/2010 | Weiser | E01C 19/48 404/84.05 |

FOREIGN PATENT DOCUMENTS

| | | |
|---|---|---|
| CN | 101864721 | 10/2010 |
| WO | 0047822 | 8/2000 |

* cited by examiner

*Primary Examiner* — Raymond W Addie

(57) ABSTRACT

A system and a method for monitoring a condition of a paving machine. The system includes a screed plate and a heating element for heating the screed plate. The system also includes a controller configured to determine a heat-up time for the screed plate and compare the heat-up time to a predetermined time. The controller is further configured to provide a signal indicating that the screed plate needs to be replaced if the heat-up time is less than or equal to the predetermined time.

20 Claims, 3 Drawing Sheets

SYSTEM AND METHOD FOR MONITORING A CONDITION OF A PAVING MACHINE

TECHNICAL FIELD

The present disclosure generally relates to a paving machine. More particularly, the present disclosure relates to a system and a method for monitoring condition of the paving machine.

BACKGROUND

Paving machines are used to apply, spread, and compact a mat paving material over a paving surface. A paving machine generally includes a tractor and a screed assembly having a number of screed plates. The tractor has a hopper for receiving paving material such as, asphalt, from a truck and a conveyor system for transferring the paving material rearwardly from the hopper for discharge onto the paving surface. The paving machine includes augers to spread the paving material across the paving surface in front of the screed assembly.

The screed assembly smoothens and compacts the paving material on the paving surface. To facilitate a proper deposition of the paving material, the screed plates are typically heated. Heating the screed plates assists the paving material in flowing under the screed plates and reduces adhesion of the paving material to the screed plates. If the screed plates are not adequately heated, the bituminous mixture of the paving material contacts the bottom of the screed plate and begins to harden, resulting in build-up of paving material and excessive drag. Generally, screed plates are heated to a temperature close to the temperature of the heated asphalt material.

U.S. Pat. No. 6,334,735 is related to a controller for a heating system of a paving screed including a screed plate. The heating system is connected with the screed and configured to transfer thermal energy to the screed plate and includes an actuator configured to adjust thermal energy output of the heating system. The controller includes a temperature sensor connectable with the screed and configured to sense temperature of the screed plate. The sensor is also configured to generate electrical signals proportional to sensed temperature. An electrical logic circuit is electrically connected with the sensor and is electrically connectable with the actuator. The logic circuit is configured to compare a temperature signal from the sensor with a desired temperature value and to automatically operate the actuator such that the actuator adjusts thermal energy output of the heating system so as to maintain screed temperature about the desired temperature value.

The screed plates may undergo wear and tear over a period of time due to friction with the paving material, temperature etc. The screed plates may not wear evenly and the misshaped plates affect the mat and a performance of the machine. As such, the screed plates may need to be replaced as and when required for smooth operation of the paving machine. Conventionally, the screed plates are checked and replaced based on the service life or every season.

However, in some cases, the screed plates may be non-operational and may need to be replaced sooner even before their service life due to various other reasons such as, harsh and dynamically changing operating conditions, amount of material laid, operator error etc. Offline checking of the screed plates for damage may decrease the operational time of the paving machine and may affect the productivity. As such, there exists a need for efficiently monitoring a condition of the paving machine.

SUMMARY OF THE DISCLOSURE

In an aspect of the present disclosure, a system for monitoring a condition of a paving machine is provided. The system includes a screed plate and a heating element for heating the screed plate. The system further includes a controller configured to determine a heat-up time for the screed plate and compare the heat-up time to a predetermined time. The controller is further configured to provide a signal indicating that the screed plate needs to be replaced if the heat-up time is less than or equal to the predetermined time.

In another aspect of the present disclosure, a method of monitoring a condition of a paving machine is provided. The method includes determining a heat-up time for the screed plate and comparing the heat-up time to a predetermined time. The method further includes providing a signal indicating that the screed plate needs to be replaced if the heat-up time is less than or equal to the predetermined time.

In yet another aspect of the present disclosure, a system for monitoring a condition of a screed plate is provided. The system includes a heating element for heating the screed plate. The system also includes a controller configured to determine a heat-up time for the screed plate and compare the heat up time to a predetermined time. The controller is further configured to provide a signal indicating that the screed plate needs to be replaced if the heat-up time is less than or equal to a predetermined time.

Other features and aspects of this disclosure will be apparent from the following description and the accompanying drawings.

BRIEF DESCRIPTION OF THE DRAWINGS

The features and advantages of the present disclosure will become more apparent from the detailed description set forth below when taken in conjunction with the drawings.

DETAILED DESCRIPTION

Figure 1:
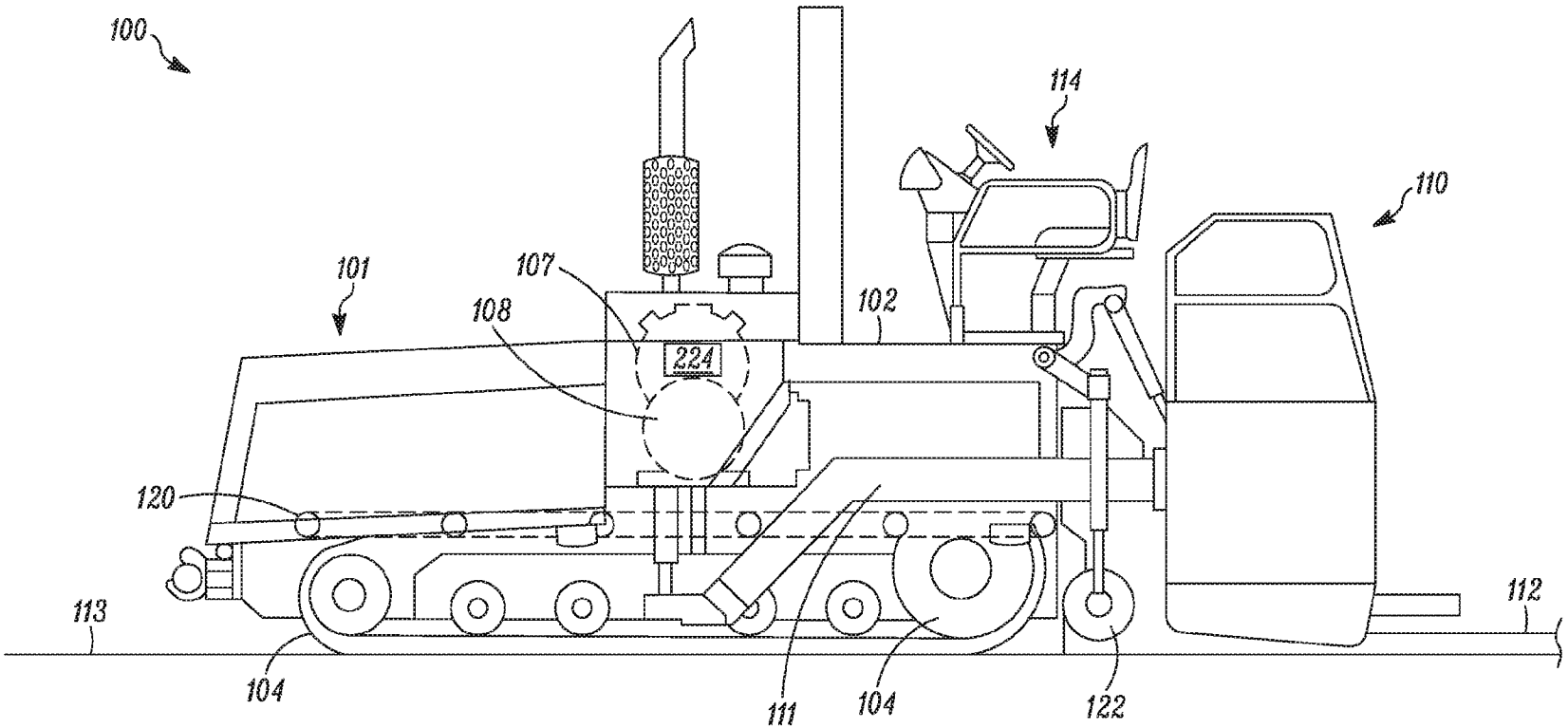
FIG. 1 is a side view of an exemplary paving machine having a screed assembly, according to an embodiment of the present disclosure.

Wherever possible, the same reference numbers will be used throughout the drawings to refer to the same or the like parts. Referring to FIG. 1, an exemplary paving machine 100 (hereinafter referred to as "the machine 100") is illustrated. Although, the paving machine 100 is depicted in the FIG. 1 as an asphalt paver, the presently disclosed concepts may be used on any kind of a paving machine and for any kind of material engaging operation performed by the work surface machine, that may form a layer of material on a paving surface.

As shown in FIG. 1, the machine 100 may include a tractor 101 having a frame 102. The machine 100 may also include one or more traction devices 104 coupled with the frame 102 that has a front end 105 and a rear end 106. In the illustrated embodiment, the traction devices 104 includes wheels. However, in various alternative embodiments, the traction devices 104 may include other types of ground engaging members such as bogies, tracks and the like. Further, the traction devices 104 could also include different combinations of the ground engaging members. For example, the paving machine 100 may include a combination of wheels and tracks.

The traction device 104 may be driven by a power source, e.g., an engine 107 via a transmission (not shown). The transmission may be a hydrostatic transmission or a mechanical transmission. The engine 107 may further drive an associated generator 108 that is used to power various system on the machine 100.

Figure 2:
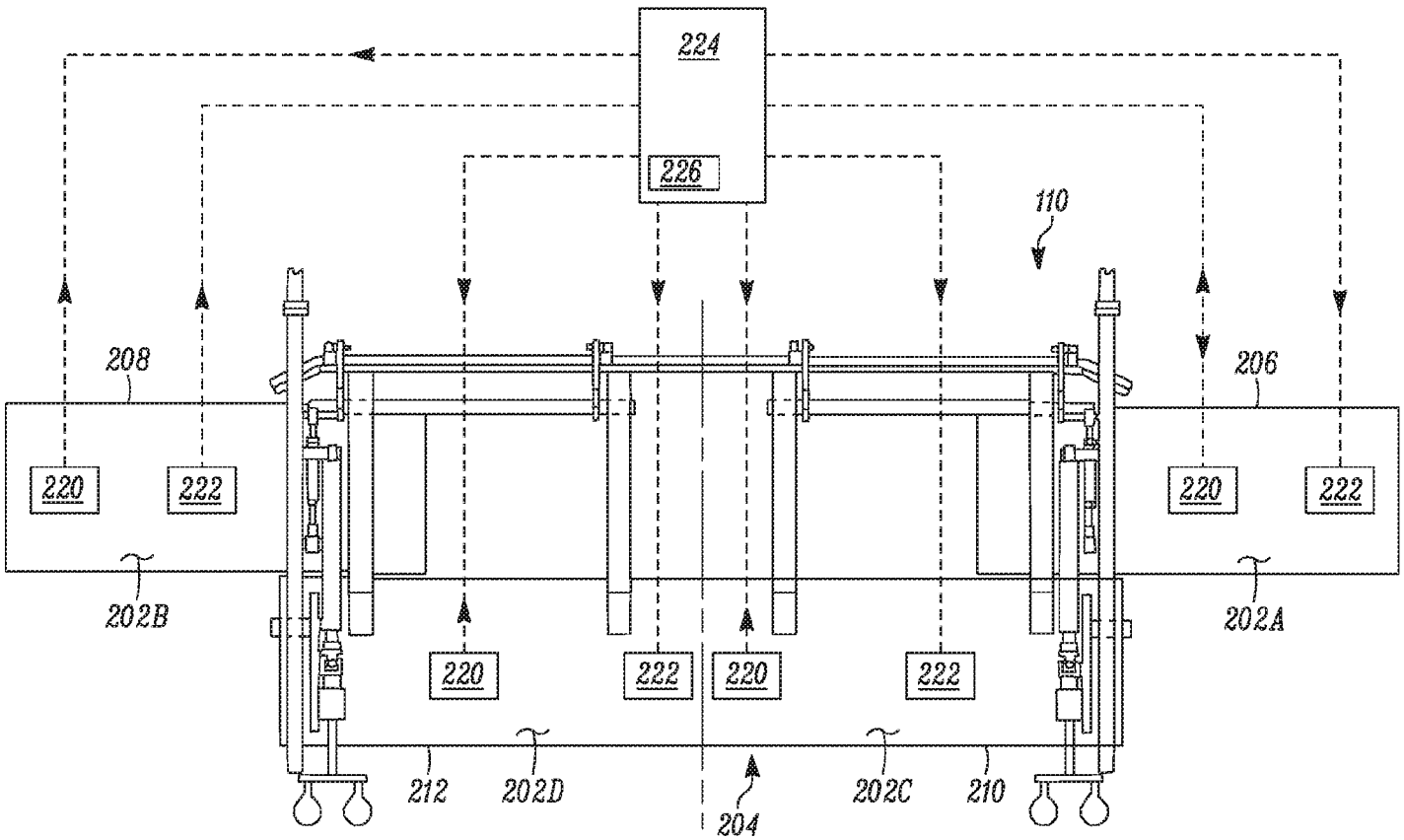
FIG. 2 is a plan view of the screed assembly of FIG. 1, and an associated system for monitoring a condition of the paving machine, according to an embodiment of the present disclosure.

Referring to FIGS. 1 and 2, the paving machine 100 also includes a screed assembly 110 that is coupled to the tractor 101 and attached at the rear end 106 of the frame 102. The screed assembly 110 is configured to spread and compact a material into a layer or mat 112 of desired thickness, size and uniformity on a ground surface 113.

The screed assembly 110 may be connected behind the machine 100 by a pair of tow arms 111 (only one of which is visible in FIG. 1) that may extend between the frame 102 of the machine 100 and the screed assembly 110. The tow arms 111 are pivotally connected to the frame 102 such that the relative position and orientation of the screed assembly 110 relative to the frame 102, and the ground surface 113, may be adjusted by pivoting the tow arms 111 in order, for example, to control a thickness of the paving material deposited on the ground surface 113. The screed assembly 110 includes multiple screed plates 202 (shown in FIG. 2). The screed plates 202 and a system for monitoring a condition of the screed plates 202, will be explained in detail in conjunction with FIG. 2.

Referring to FIG. 1, the machine 100 may also include an operator station 114, and may also include a user interface (not shown) for accepting user input and displaying information to the operator.

The machine 100 may also include an auger 122 coupled to the tractor 101 and located between the tractor 101 and the screed assembly 110. The auger 122 may be placed at the rear end 106 of the frame 102 and adjacent to the screed assembly 110. The auger 122 is configured to receive the paving material supplied by the conveyors 120 and spread the material evenly ahead of the screed assembly 110. In an example, the auger 122 may be a screw auger. The machine 100 may have a single auger 122 or any number of augers 122.

Referring to FIGS. 1 and 2, the screed assembly 110 may be any of a number of configurations such as, but not limited to, a fixed width screed, a rear mount extendible screed, a front mount extendible screed, or a multiple section screed that includes extensions.

In the illustrated embodiment of FIG. 2, the screed assembly 100 includes a main screed section 204 and screed extensions 206, 208. It should be understood that the screed extensions 206, 208 are shown as being front mounted but can be either front or rear mounted extensions. In an extended mode, the screed extensions 206, 208 may extend outwardly from either side of the main screed 204. The screed extensions 206, 208 may include separate screed plates 202A, 202B.

The main screed 204 may include first and second sections 210, 212 one on each side of a longitudinal central axis. The screed extensions 206, 208 may be slidably mounted to the first and second sections 210, 212 of the main screed 204 respectively. The main screed 204 and first and second sections 210, 212 may include screed plates 202C, 202D or alternatively only a single screed plate. Thus, the main screed 204 may include multiple screed plates 202A, 202B, 202C, 202D (also collectively referred to as the screed plates 202).

In an embodiment, the screed assembly 110 may include a vibratory mechanism (not shown) positioned above the first and second screed sections 210, 212 and the screed extensions 206, 208 to aid in the initial compaction of the paving material being laid down.

The screed assembly 110 may function to spread the paving material distributed by the paving machine 100 onto the ground surface. In order to achieve an optimum workability of the paving material, a temperature of the screed plates 202 may need be maintained at a desired temperature or within a predetermined temperature range. This desired temperature or the temperature range may depend upon the paving material, paving surface, ambient conditions etc.

As shown in the FIG. 2, the screed plates 202 is provided with one or more heating elements 220. The screed plates 202 may be heated by the heating elements 220, such that a thermal energy may be transferred from the screed plates 202 to the material.

The screed assembly 110 may also be powered by the generator 108 or the engine 107. The generator 108 may be used to power multiple components associated with the screed assembly 110, for example, crown actuators (not shown), the heating elements 220 etc.

It should be noted that the configuration of the screed assembly 110 and the screed plates 202 described herein is merely exemplary in nature, and the concepts of the present disclosure may be suitably implemented for any configuration of the screed assembly 110 that has a screed plate 202.

In an embodiment, the heating elements 220 may be disposed on each screed plates 202A, 202B, 202C, 202D. Further, the heating elements 220 may also be disposed on forward portions and/or rearward portions of the screed plates 202. However, this disclosure is not limited to this construction and other numbers of heating elements 220 may be provided for each screed plate. The heating elements may also be associated with one or more controls such as, an on/off switch, a warm-up switch and the like.

In one embodiment, the heating element 220 may include an electrical heater (not shown). In an example, the electric heater may be a sheet formed from a resistive conductive wire. The heating element 220 may be fixed or bonded to the screed plate 202 by suitable bonding materials. The electric heater may be powered by a power source such as the generator 108. In another embodiment, the heating element 220 may include gas burners (not shown) e.g., propane heaters, diesel heaters and the like. In yet another embodiment, the heating element 220 may include an electrically controlled heating pad.

The heating element 220 may switch into an energized state to start heating the screed plate 202. Further, the heating element 220 may change into a de-energized state after heating the screed plate 202. In an embodiment, the heating element 220 may switch to the de-energized state upon determining that the screed plate 202 has reached a desired temperature.

In an embodiment, the heating element 220 may be controlled by an electric logic circuit. For example, the heating element 220 may be configured to heat the screed plate 202 to the desired temperature. The heating element 220 may receive a feedback of the temperature of the screed plate 202, and regulate accordingly to maintain the screed plate 202 at the desired temperature. In another embodiment, the heating element 220 may change into the de-energized state based on its own temperature.

As shown in FIG. 2, the screed plate 202 is provided with one or more temperature sensors 222 configured to provide a temperature of the screed plate 202. In one embodiment, the temperature sensors 222 may be disposed on each of the screed plates 202 of the screed assembly 110. Additionally or optionally, the temperature sensors 222 may be disposed at multiple locations on each of the screed plates 202.

In another embodiment, the temperature sensor 222 may be provided on one of the screed plate 202 that is more prone to wear based on the application of the machine 100. It may be contemplated to provide the temperature sensor 222 at any suitable location on the screed plate 202 to enable measuring of the temperature of the screed plate 202. Alternatively, the temperature sensor 222 may be suitably disposed on the heating element 220. In another embodiment, the temperature sensor 222 may form part of the heating element 220 or integrated therein.

In one embodiment, the temperature sensor 222 is a thermocouple. Alternatively, the temperature sensor 222 may be any other appropriate device that is capable of measuring the temperature of the screed plate 202. In one embodiment, the heating element 220 may be in communication with the temperature sensor 222. The heating element 220 may utilize a feedback provided by the temperature sensor 222 to regulate the temperature of the screed plate 202. Further, the temperature sensor 222 may be encased inside a housing (not shown) to protect internal components from the foreign particles.

As shown in FIG. 1 and FIG. 2, the machine also includes a controller 224. The controller is configured to monitor a condition of the paving machine 100. In an embodiment, the controller 224 is an electronic control module of the machine 100. The controller 224 may include a microprocessor, an application specific integrated circuit ("ASIC"), or other appropriate circuitry and may have a memory or other data storage capabilities. The controller 224 may include functions, steps, routines, data tables, data maps, charts and the like saved in and executable from read only memory to monitor the productivity of the paving machine 100.

Although, the controller 224 is illustrated as a single, discrete unit, in other embodiments the controller 224 and its functions may be distributed among multiple distinct and separate components. The controller 224 may also be operatively associated with various other components of the machine 100, such as actuators associated with the screed assembly 110.

Communication between the controller 224 and the other electrical components such as the temperature sensor 222, heating element 220 may be established by sending and receiving digital or analog signals across electronic communication lines or communication busses, including by wireless communication.

The controller 224 is configured to determine a heat-up time for the screed plate 202. More specifically, the controller 224 may determine a time required for the screed plate 202 to reach a predetermined temperature. In one example, the predetermined temperature may be the desired temperature for the screed plate 202 at which a required quality of the mat may be obtained as discussed above.

The predetermined temperature may be set for the paving machine 100 based on various parameters related to a type and density of the material used, a geometry of the screed plates 202 and the like. In an embodiment, the controller 224 may be configured to provide an energizing signal for commanding the heating element 220 to heat the screed plate 202 and a de-energizing signal for commanding the heating element 220 to turn off. Accordingly, the heating elements 220 may be configured to heat the screed plates 202 to the predetermined temperature. For example, the heating elements 220 may be energized to start heating of the screed plates 202. Further, the heating elements 220 may be de-energized to cease heating of the screed plate 202 upon reaching the predetermined temperature.

In one embodiment, the controller 224 may determine the heat-up time based on signals received from the temperature sensor 222. The controller 224 may utilize temperature signals at each of a starting and ceasing of heating the screed plate 202 to determine the heat-up time. For example, a software logic may be implemented by the controller 224 and/or the temperature sensor 222 to determine when the heating of the screed plate 202 started and when the heating ceased. The time duration between the starting and ceasing of the heating may be determined as the heat-up time. Moreover, the controller 224 may utilize a rate of change of temperature of the screed plate 202 to determine the heat-up time for the screed plate 202.

In an embodiment, the controller 224 may receive signals from the multiple temperature sensors 222 disposed at various locations on the screed plate 202. In such a case, the controller 224 may determine a heat-up time for each of the locations of the screed plate 202. Further, the controller 224 may consider the lowest heat-up time as the heat-up time for the screed plate 202.

In another embodiment, the controller 224 may determine the heat-up time based on signals communicated to the heating element 220. The controller 224 may be configured to monitor the energizing and de-energizing sate of the heating element 220. For example, the controller 224 may monitor an ON signal and an OFF signal of the heating element 220. Accordingly, the controller 224 may determine the heat-up time based on a time taken to switch from the energized state or the ON-signal to the de-energized state or the OFF signal respectively.

In yet another embodiment, the system may further include a timer 226 communicably coupled with the controller 224. In an example, the timer 226 may be integrated with the controller 224. In an embodiment, the controller 224 may start the timer 226 when the heating of the screed plate 202 started. Further, the timer 226 may end the timer 226 when the heating of the screed plate 202 is ceased. Alternatively, the controller 224 may receive readings of the timer 226 when the heating of the screed plate 202 and started and ceased.

In one embodiment, the controller 224 may determine that the heating of the screed plate 202 started and/or that the heating of the screed plate 202 is ceased based on the signals from the temperature sensor 222. In another embodiment, the controller 224 may determine that the heating of the screed plate 202 started and/or that the heating of the screed plate 202 is ceased based on the signals from the heating element 220, for example, the ON-signal, the OFF-signal.

In yet another embodiment, the controller 224 may utilize a combination of the signals received each from the heating element 220 and the temperature sensor 222 to determine that starting and ceasing or end of the heating of the screed plate 202.

Further, the controller 224 may compare the heat-up time to a predetermined time. In an embodiment, the controller 224 may retrieve the predetermined time from a memory. In an example, the predetermined time is a time period required for heating the screed plate 202 to the predetermined temperature, when the screed plate 202 is in a healthy state and have not worn out. The screed plate 202 of a certain thickness or a volume may take the predetermined time to heat-up. However, due to wear or other factors, an effective volume of the screed plate 202 may decrease. As such, as the thickness or the volume of the screed plate 202 decreases, less amount of time may be taken to heat the screed plate 202.

In an embodiment, the controller 224 may calculate the predetermined time corresponding to that particular machine 100, based on a historic data. For example, the controller 224 may monitor the time taken for the screed plate 202 to heat for a number of times, along with other parameters such as, ambient temperature etc. Accordingly, based on these historic heat-up times, the controller 224 may calculate the predetermined time. In a further embodiment, the controller 224 may continuously monitor a heat-up time of the screed plate 202 and compare the new heat-up time value with the old ones. The controller 224 may accordingly, determine if there is a significant change in the new heat-up time compared to the old ones.

As such, the controller 224 may compare the heat-up time to the predetermined time. Further, the controller 224 may provide a signal indicating that the screed plate 202 needs to be replaced if the heat-up time is less than or equal to the predetermined time. The decrease in heat-up time may be due to decrease in thickness of the screed plate 202 due to wear, tear or damage during an operation of the machine 100.

In yet another embodiment, the controller 224 may determine the heat-up time as a rate of change of temperature of the screed plate 202. For example, the controller 224 may determine the heat-up time as a slope of a time Vs temperature plot, wherein the temperature values of the screed plate 202 are received at different time intervals. In such a case, the predetermined time may also correspond to a rate of change of temperature of the screed plate 202. In an example, as discussed above, the predetermined time may be determined based on the historic data of the screed plate 202.

In an embodiment, the controller 224 may monitor the rate of change of the temperature of the screed plate 202. Further, the controller 224 may determine if the screed plate 202 is worn based on the rate of change of the temperature of the screed plate 202. For example, the controller 224 may determine that the screed plate 202 needs to be replaced, if there is a significant increase in the rate of change of temperature of the screed plate 202 over time.

It should be noted that, although the concepts herein are described for one screed plate 202, it may be envisioned that the controller 224 may implement the similar concepts and methodologies to one or more of the screed plates 202 of the screed assembly 110 as needed. For example, the controller 224 may determine the heat-up time for each of the screed plates 202. Further, the controller may compare the heat-up times with the respective predetermined times to determine if the corresponding screed plate 202 needs to be replaced.

In one embodiment, the controller 224 may provide an alert on a display device in the operator station 114. In another embodiment, the controller 224 may communicate the signal regarding the condition of the paving machine 100 to an operator, or some remote personnel equipped with a computer or a mobile device. These personnel can include job-site foreman, paver operators, paver owners, inspectors etc.

In an embodiment, the controller 224 may implement the algorithm described above continuously and determine the heat-up time whenever, the screed plate 202 is being heated. Alternatively, the controller 224 may implement the algorithm periodically.

INDUSTRIAL APPLICABILITY

With use and implementation of the controller 224 of the present disclosure, the condition of the paving machine 100 may be determined. Specifically, the controller 224 is configured to determine when the screed plates 202 of the machine 100 needs to be replaced. Moreover, the controller 224 analyses the usual process of heating the screed plate 202 to determine if the screed plate 202 needs to be replaced. Further, by disposing the temperature sensors 222 on the screed plates 202, a temperature of the screed plates 202 is determined, and based on which the life of the screed plate 202 is determined.

Figure 3:
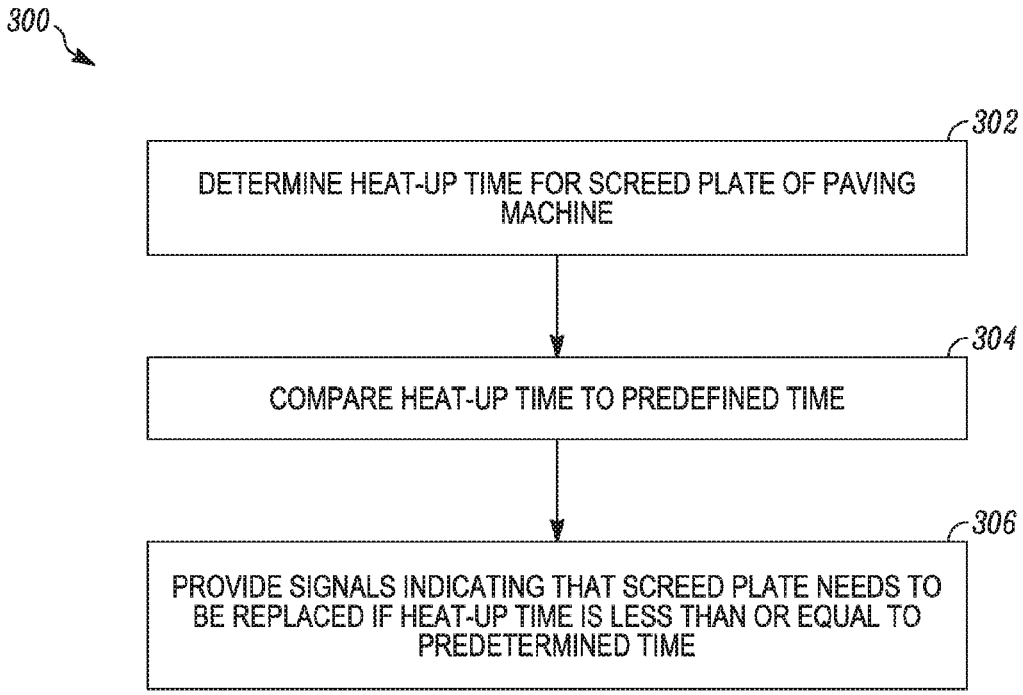
FIG. 3 is a flowchart for a method of monitoring a condition of the paving machine, according to an embodiment of the present disclosure.

Referring to FIG. 3, the present disclosure is also related to a method 300 of monitoring a condition of a paving machine 100. In an embodiment, one or more steps of the method may be performed by the controller 224 and other associated components of the machine 100. The method 300 will be explained hereinafter in conjunction with the paving machine 100, however, it may be contemplated to implement the concepts of the method 300 to any other paving machine 100 without deviating from the scope of the present disclosure.

At step 302, the method 300 includes, determining the heat-up time of the screed plate 202. In one embodiment, the heat-up time may be determined based on the signals receiving through the temperature sensor 222. The starting time and ending time of heating the screed plate 202 may be determined by a suitable software logic implemented by the controller 224 and/or the temperature sensor 222. Accordingly, based on the temperature signals received at the starting time and the ending time, the heat-up time may be determined.

In another embodiment, the heat-up time may be determined based on the signals from the heating element 220. For example, the heat-up time may be determined based on how long the heating element 220 is energized. Accordingly, the ON-signal or the energizing signal and the OFF signal or the de-energizing signal may be monitored and time duration between them may be determined as the heat-up time. In some cases, an offset may be added to the time duration between the energizing signal and the de-energizing signal to account for any lag in transfer of heat from the heating element 220 to the screed plate 202.

In yet another embodiment, the heat-up time may be determined based on a time required for the temperature of the screed plate 202 to reach the predetermined temperature. In such a case, the readings on the timer 226 at the start of heating the screed plate 202 and when the temperature reaches the predetermined temperature may be noted to determine the heat-up time.

Other combinations of methods such as using the temperature signal to determine the start of heating and using the signal from the heating element 220 to determine end of the heating may be used to determine the heat-up time. Moreover, multiple heat-up times may be calculated based on the methodologies described according to various embodiments. Further, the lowest among these may be considered as the heat-up time of the screed plate 202.

At step 304, the method 300 includes comparing the heat-up time to the predetermined time. At step 306, the method includes providing a signal indicating that the screed plate 202 needs to be replaced if the heat-up time is less than or equal to the predetermined time. The screed plate 202 may present a less volume for the heating element 220 to heat the screed plate 202 upon wear and/or tear. As such, the screed plate 202 of considerably less volume may require less time to heat-up. Such a determination may be used to determine the condition of the screed plates 202.

Moreover, all the screed plates 202A, 202B, 202C, 202D or the screed plates 202 that are more prone to wear may be equipped with the temperature sensors 222. Further, the life of these screed plates 202 may be determined with implementation of the method and/or the system. The condition of the screed plate 202 may be determined during normal operation of the machine and by using existing process of heating the screed plates 202. As such, non-operational time of the machine to check the screed plates 202 separately may be reduced.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for monitoring a condition of a paving machine, the system comprising:
- a screed plate;
- a heating element for heating the screed plate; and
- a controller configured to:
  - determine a heat-up time for the screed plate;
  - compare the heat-up time to a predetermined time; and
  - provide a signal indicating that the screed plate needs to be replaced if the heat-up time is less than or equal to the predetermined time.

2. The system of claim 1 further comprising a temperature sensor for providing a screed plate temperature.

3. The system of claim 2, wherein the controller is further configured to:
- receive a signal indicative of the screed plate temperature from the temperature sensor; and
- determine the heat-up time based on the signal received from the temperature sensor.

4. The system of claim 2, wherein the temperature sensor includes a plurality of temperature sensors disposed on multiple locations on the screed plate.

5. The system of claim 4, wherein the controller is further configured to:
- receive, from the plurality of temperature sensors, a plurality of temperatures corresponding to multiple locations on the screed plate;
- determine individual time durations of each of the plurality of temperatures corresponding to the multiple locations to reach a predetermined temperature; and
- determine the heat-up time of the screed plate as a lowest time duration among the individual time durations.

6. The system of claim 1, wherein the controller is further configured to provide an energizing signal for commanding the heating element to heat the screed plate and a de-energizing signal for commanding the heating element to turn off, and the controller determines the heat-up time based on the energizing signal and the de-energizing signal from the heating element.

7. The system of claim 1, wherein the controller is configured to determine the heat-up time based on a time required for a screed plate temperature to reach a predetermined temperature.

8. The system of claim 1, wherein the controller is configured to determine the heat-up time based on a starting time and an end time for heating the screed plate.

9. The system of claim 8, wherein the controller is configured to determine the starting time based on at least one of an energizing signal from the heating element and a signal from a temperature sensor disposed on the screed plate.

10. The system of claim 8, wherein the controller is configured to determine the end time based on at least one of a de-energizing signal from the heating element and a signal from a temperature sensor disposed on the screed plate.

11. A method of monitoring a condition of a paving machine, the method comprising:
- determining a heat-up time for a screed plate of the paving machine;
- comparing the heat-up time to a predetermined time; and
- providing a signal indicating that the screed plate needs to be replaced if the heat-up time is less than or equal to the predetermined time.

12. The method of claim 11 further comprising:
- receiving a signal indicative of a temperature of the screed plate from a temperature sensor disposed on the screed plate; and
- determining the heat-up time based on the signal from the temperature sensor.

13. The method of claim 11, wherein the heat-up time is determined based on a time required for a temperature of the screed plate to reach a predetermined temperature.

14. The method of claim 11 further comprising receiving at least one of an energizing signal and a de-energizing signal from a heating element, the heating element configured to heat the screed plate.

15. The method of claim 14, wherein the heat-up time is determined based on a time duration between the energizing signal and the de-energizing signal.

16. The method of claim 14, wherein the heat-up time is determined based on a combination of signals from a temperature sensor and the signals from the heating element.

17. A system for monitoring a condition of a screed plate of a paving machine, the system comprising:
- a heating element for heating the screed plate; and
- a controller configured to:
  - determine a heat-up time for the screed plate;
  - compare the heat-up time to a predetermined time; and
  - provide a signal indicating that the screed plate needs to be replaced if the heat-up time is less than or equal to the predetermined time.

18. The system of claim 17 further comprising a temperature sensor for providing a screed plate temperature, wherein the controller is further configured to:
- receive a signal indicative of the screed plate temperature from the temperature sensor; and
- determine the heat-up time based on the signal received from the temperature sensor.

19. The system of claim 17, wherein the controller is further configured to provide an energizing signal for commanding the heating element to heat the screed plate and a de-energizing signal for commanding the heating element to turn off, and the controller determines the heat-up time based on the energizing signal and the de-energizing signal from the heating element.

20. The system of claim 17, wherein the controller is configured to determine the heat-up time based on a time required for a screed plate temperature to reach a predetermined temperature.

* * * * *